US006868873B2

(12) United States Patent
Frisk

(10) Patent No.: US 6,868,873 B2
(45) Date of Patent: Mar. 22, 2005

(54) METHOD FOR FILLING, APPARATUS FOR FILLING, AND CONTAINER FOR FILLING AND PACKAGING

(75) Inventor: Peter Frisk, Tokyo (JP)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 10/311,937

(22) PCT Filed: Jun. 22, 2001

(86) PCT No.: PCT/JP01/05364

§ 371 (c)(1),
(2), (4) Date: Jun. 2, 2003

(87) PCT Pub. No.: WO01/98150

PCT Pub. Date: Dec. 27, 2001

(65) Prior Publication Data

US 2004/0013564 A1 Jan. 22, 2004

(30) Foreign Application Priority Data

Jun. 23, 2000 (JP) ..... 2000-188814

(51) Int. Cl.[7] ..... B65B 1/20

(52) U.S. Cl. ..... 141/11; 141/2; 141/69; 141/85; 141/89; 53/432; 427/237

(58) Field of Search ..... 141/2, 4, 5, 7, 141/9, 11, 57, 63, 69, 70, 85, 89, 91, 92, 103; 427/583–586, 237, 238, 255.37; 53/432

(56) References Cited

U.S. PATENT DOCUMENTS

| | | | | |
|---|---|---|---|---|
| 2,687,740 A | | 8/1954 | Järund | |
| 2,869,299 A | | 1/1959 | Järund | |
| 3,331,902 A | | 7/1967 | Stark | |
| 3,531,908 A | | 10/1970 | Rausing et al. | |
| 4,753,818 A | | 6/1988 | Rogers, Jr. | |
| 4,759,695 A | | 7/1988 | Bordini | |
| 5,007,232 A | * | 4/1991 | Caudill | 53/426 |
| 5,800,880 A | * | 9/1998 | Laurent | 427/583 |
| 5,819,507 A | | 10/1998 | Kaneko et al. | |
| 6,684,916 B2 | * | 2/2004 | Py | 141/2 |

FOREIGN PATENT DOCUMENTS

| | | |
|---|---|---|
| JP | 62-4038 A | 1/1987 |
| JP | 6-182923 A | 7/1994 |
| JP | 9-99921 A | 4/1997 |
| JP | 10-86913 A | 4/1998 |
| WO | WO 98/42891 A1 | 10/1998 |

* cited by examiner

*Primary Examiner*—Timothy L. Maust
(74) *Attorney, Agent, or Firm*—Burns, Doane, Swecker & Mathis, L.L.P.

(57) ABSTRACT

A method for filling a container involves supplying a barrier layer to the inside of a container and irradiating the inside with a high energy ray to form a barrier layer on the inner surface of the container and simultaneously sterilizing the inside and discharging a residual barrier material precursor gas and a by-product gas from the container before or during the filling of liquid food into the container. The method allows the formation of a continuous barrier layer covering edges, gloves, clearances and gaps inside the container. Automatic and effective discharge of a residual barrier material precursor gas and a by-product gas from the container through the filling of liquid food is allowed. The method avoids the necessity of chemical disinfectants through sterilization of the inside of a container by irradiation with a high energy ray and thereafter filling a liquid food in an aseptic state.

4 Claims, 2 Drawing Sheets

METHOD FOR FILLING, APPARATUS FOR FILLING, AND CONTAINER FOR FILLING AND PACKAGING

TECHNICAL FIELD

This invention relates to a method for filling which comprises coating a barrier layer of silicon oxides to an inner wall of a container, a filling machine and a container for packing and filling.

BACKGROUND ART

Over the years, flexible packing lamination material and a bottle of glass and plastic have been used for liquid food packing. A packing container for use in milk, juice, refined sake, mineral water and other drinks, for example, a gable-top paper packaging container of a laminated packaging material of fibrous substrate (for example, paper)/plastic is produced by cutting web-shaped paper packaging material having crease lines in a predetermined configuration to obtain a lengthwise seal, sterilizing the container inside in ultraviolet radiation and a chemical disinfectant of hydrogen peroxide after a seal at the bottom of blanks in filling machine, drying the container inside after removal of hydrogen peroxide, filling a content of milk, juice or other drink from an upper part opening, and sealing the upper part. Appearance design of the packing container product is printed on a surface of the packaging material. If long-term preservation is necessary, the packaging material where the desired barrier layer is laminated is used. In addition, the technique of depositing a barrier layer to an inner wall of a formed container directly is used. (WO 9842891).

DISCLOSURE OF INVENTION

The present invention is a filling method which comprises supplying a barrier layer forming raw material (a barrier material precursor gas) in a container inside, irradiating the inside with a high energy ray thereby forming a barrier layer on the inner surface of the container and at the same time sterilizing the container inside, discharging a residual gas barrier material precursor gas and a by-product gas from the container inside before or during the filling of a liquid food.

In a preferred embodiment of this invention, the filling method includes coating a barrier layer on a whole container inside, except a container upper inside such that a heat sealable polymer surface is exposed on the inside of the container upper part.

In a further embodiment of this invention, a filling machine comprises a filling nozzle filling a liquid food into a container inside with an insert from an opening of the container, a high energy ray irradiation source irradiating the container inside before the filling, a feeding route supplying a barrier layer forming material (barrier material precursor gas) into the container inside, wherein the filling nozzle is provided along with the feeding route or is provided with the route in common, before or during the filling of a liquid food to the container inside, residual precursor gas and/or by-product gas is discharged from the container inside.

In another embodiment of this invention, a container for packing and filling formed from a sheet-shaped paper lamination material comprises a barrier layer which, just before the filling, is formed by means of irradiation of a high energy ray on a container inside, where the inside of the formed container includes the discontinuous surface of the side wall and the bottom.

In preferred embodiment of the container for packing and filling, the barrier layer comprises a SiOx layer, in which the x has range of 1.5–2.5.

In preferred embodiment of this invention, the high-energy radiation source is an ultraviolet radiation source, and comprises at least one excimer ultraviolet lamp emitting high-energy radiation ray within the wavelength range of ultraviolet radiation.

In a container formed by folding and bending, the container inside has slits, gaps, exposed end faces, small grooves, and small cracks. Even if the barrier layer is formed, the conventional container for packing and filling cannot protect such a discontinuous portion. According to this invention, the end faces, grooves, cracks, gaps and etc. are covered by the barrier layer, and a continuous barrier layer can be formed.

Because, by means of this invention, the continual barrier layer is formed on the innermost layer coming in contact with a contents product, aroma and flavors are not missed. It is effective to fill very sensitive contents products such as juice, tea.

Because the gas feeding route for barrier layer forming raw material (barrier materials precursor gas) is used in common or shared with the filling nozzle for liquid food, with the faster shift from the feeding step of barrier layer forming raw material (barrier materials precursor gas), to the filling step of the liquid food, this invention speeds up the process.

In addition, during the filling of liquid food, residual barrier materials precursor gas or by-product gas is effectively discharged automatically from the container inside.

If necessary, after the filling of liquid food, replacement to an aseptic gas is possible by blowing into an opening of sterilized nitrogen gas just before the sealing of container.

According to this invention, the container inside is sterilized by irradiation of high-energy ray, because the liquid food is immediately filled in aseptic condition without using chemical disinfectant, e.g. hydrogen peroxide. In addition, the energy can be effectively used.

A use-by date and a quality guarantee period can be extended by sterilizing the container inside according to this invention.

BRIEF DESCRIPTION OF DRAWINGS

FIG. 2 also shows supplying a barrier layer forming raw material (barrier materials precursor gas) in the container inside.

BEST MODE FOR CARRYING OUT THE INVENTION

In this invention, an example of the structure of the packing lamination materials is printing layer/outermost layer of water proofing thermoplastic material/paper layer/blend layer of polyamide/adhesive layer/heat sealable polymer layer (polyolefin).

The polyolefin includes low-density polyethylene (LDPE), linear low-density polyethylene by a metallocene catalyst (mLLDPE) etc. The blend of polyamide includes a mixture of nylon MXD-6 and nylon PA-6.

At first, in the example of the filling method according to this invention, web-shaped packing lamination materials are prepared, are cut in a predetermined configuration from the materials and blanks are formed. Then, the bottom is sealed, and the blank with the bottom (an opening container) is formed. The container has an opening portion in the upper part.

The filling process is done by one step or a plurality of steps.

In the upper part of the opening container, high energy is irradiated from a high-energy source of excimer ultraviolet radiation (UV), electron beam (EB), plasma and etc, before the filling of contents product and the sealing of the opening of the container. Along with the irradiation, the barrier layer forming raw material gas (barrier materials precursor gas) is supplied into the container inside.

By the irradiation, a coating of the barrier layer is formed rapidly on the inside of the container.

The barrier layer forming raw material gas includes, for example, vaporized organic silicon compounds such as tetramethyl disiloxane (TMDSO) and hexamethyl disiloxane (HMDSO). In one case a layer of SiOx is formed on the inner wall.

In addition, when a material including carbon is supplied, a diamond-like carbon layer is formed by an exposure (irradiation) of the energy source. The processes may be done under atmospheric conditions.

The upper part of the container can be protected from the irradiation of the high-energy ray (exposure) in order to express the sealable polyolefin. By the protection, a better seal becomes possible.

By the irradiation (exposure) of high-energy ray from the energy source, microbes are eliminated substantially. The coating face side becomes aseptic.

Figure 1:
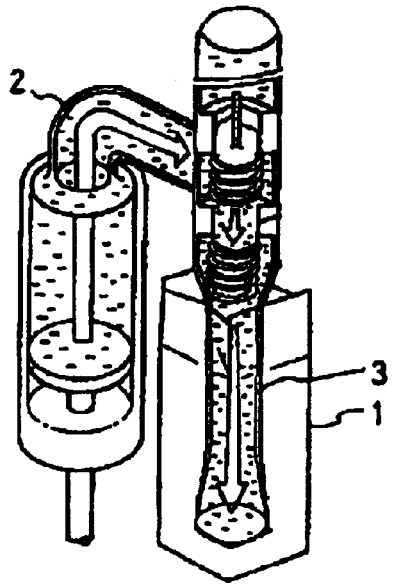
FIG. 1 is an embodiment of a filling machine according to this invention, which fills a paper container formed from a sheet-shaped packing lamination material.

In an example as in FIG. 1 according to this invention, the filling machine comprises a filling nozzle (3) filling product contents (liquid food) into the container (1) inside, a high energy ray irradiation source (not shown) to irradiate the container inside with a high energy ray before filling and, a feeding route (not shown) supplying barrier layer forming raw material gas (barrier materials precursor gas) in the container inside. The high energy ray irradiation source is added to the circumference side outside the tube-like shape filling nozzle. The supply port of a feeding route and the filling exit of liquid contents product are arranged downward.

The tubular filling nozzle and the high-energy ray irradiation source are inserted in the container from the upper part opening. The monomer (precursor) gas of the barrier layer forming raw material is blown into the container inside. The high-energy ray is irradiated to form the barrier layer.

Aseptic air from an optional removal exit removes the oxidized by-product during or after the irradiation of the energy ray. The aseptic air cools the surface.

After forming the barrier layer, the liquid contents product passes though a filling valve and is filled. Subsequently the filling valve leaves from the container after the filling. The container upper part is sealed finally. With the barrier layer formation, very little leakage from the bottom of the container inside is shielded. Superior aroma barrier property is given to the package.

Even if the barrier layer is not formed in the upper part of a container, the combination with the blend layer of polyamide of this embodiment gives extremely preferable oxygen barrier performance in the container.

The barrier layer formation reduces absorption of a flavor ingredient. Moreover, that the barrier layer covers the contact surface with contents product is meaningfully important.

In the container upper part, there is no direct contact with the contents product. The uncovered face is very small, and the comparable small top face does not influence aroma absorption.

In addition, when an opening device is sealed with the container before the filling, the inside of the opening device is coated with the barrier layer and, the barrier performance of the opening device is improved along with the barrier layer of the container.

Figure 2:
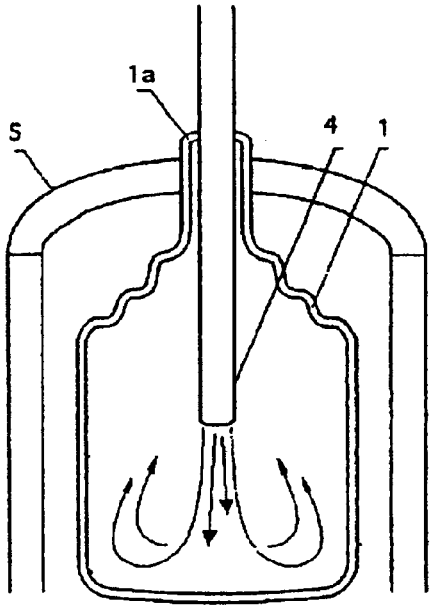
FIG. 2 is an alternative embodiment of a filling machine according to this invention, which fills a bottle-shaped container.
Figure 3:
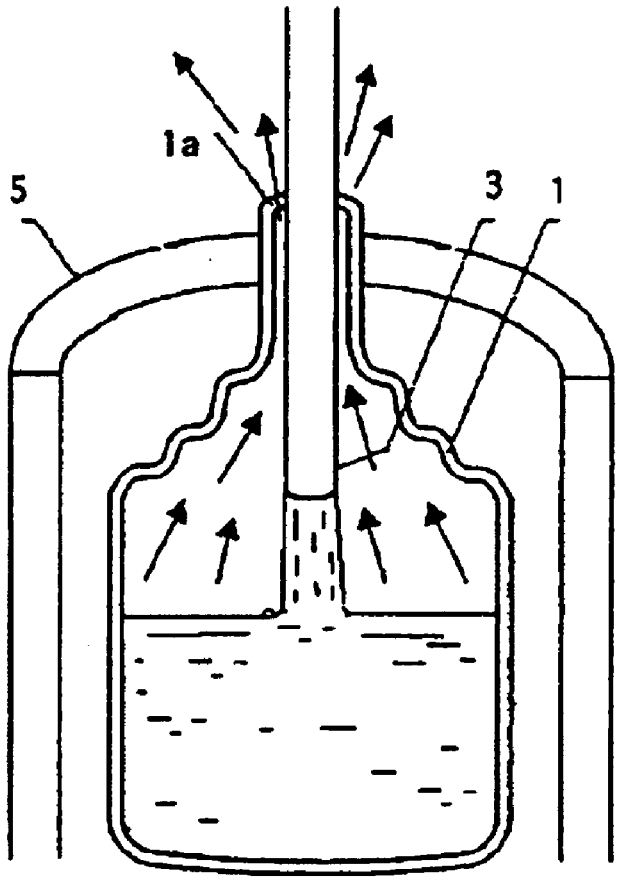
FIG. 3 is an embodiment illustrating liquid food filled in the container and thereby discharging residual barrier layer forming raw material (barrier materials precursor gas) and by-product gas from the container inside.

In a preferred embodiment of this invention, the container may have bottle shapes as shown in FIG. 2 and FIG. 3. A container (1) of this embodiment may comprise material such as polyethylene, polypropylene, copolymer of polypropylene, copolymer of polyethylene, polyethylene terephthalate, copolymer of polyethylene terephthalate or a mixture thereof.

The container may be a final shaped container and a preform.

The barrier layer forming raw material (barrier materials precursor gas) is supplied, as shown in FIG. 2, from a feeding route (4). The barrier layer forming raw material is a mixed gas. It is prepared by mixing an oxidizer gas and a carrier gas and an organo-silicon precursor gas. The organo-silicon precursor gas may include at least one organo-silicon, organosiloxane or a mixture thereof. For example, the organo-silicon precursor gas includes hexamethyl-disilane, tetramethyl-disiloxane and hexamethyl-disiloxane.

The oxidizer gas may be a gas of nitrous oxide or oxygen. The carrier gas includes argon, nitrogen or helium.

In the embodiment shown in FIG. 2, the material of the polymer container must be transparent for high energy ray of ultraviolet radiation because the high energy ray is irradiated from the outside of the container to the gaseous mixture of the container inside.

In the embodiment shown in FIG. 2, the SiOx barrier layer from the mixed gas is coated on the internal wall of the container. A general description of a chemical reaction of irradiation gas including precursor including oxygen is shown in U.S. Pat. No. 4,753,818.

While, as shown in FIG. 3, the liquid food is filled by filling nozzle (4) which is used with the feeding route (3) in common or is provided along the feeding route (3), residual gas in the inside of the container is removed from the opening **(1*a*) of the container (1)**.

The container (1) is surrounded substantially by means of a plural ultraviolet radiation source (5). In a preferred specific embodiment, the ultraviolet radiation source is a cylindrical excimer lamp emitting an ultraviolet ray having the designated wavelength. In the preferred embodiment of the present invention, the technology of excimer ultraviolet radiation is used in order to irradiate the gaseous mixture, which forms the SiOx barrier layer inside of the container.

For example, in the embodiment, the thickness of the SiOx barrier layer is about 50–500 nanometers. The present invention should not be limited by the specific range of the embodiment.

INDUSTRIAL APPLICABILITY

The filling method, the filling machine and the container for packing and filling according to this invention are used in order to pack cow's milk, juice, refined sake, shochu, mineral water and liquid food of other drink.

What is claimed is:

1. A filling method which comprises:

supplying a barrier layer forming raw material gas to an inside of a container having a side wall and a bottom, with the bottom and at least a portion of the side wall being formed from a sheet-shaped paper lamination material;

irradiating the inside of the container with a high energy ray from a high energy irradiation source inserted in the container from an opening in the container to form a barrier layer on an inner surface of the container and at the same time sterilize the inside of the container; and discharging a residual barrier material precursor gas or/and a by-product gas from the inside of the container during filling of liquid food to the inside of the container.

2. The filling method according to claim 1, wherein the barrier layer is coated on the entire inside of the container, except an upper inside of the container so that a heat sealable polymer surface is exposed on the upper inside of the container.

3. A method for filling a container comprising:

introducing a barrier layer forming raw material gas into an interior of a container formed at least in part from a paper lamination material;

positioning a high energy irradiation source in the interior of the container and irradiating the interior with a high energy ray from the high energy irradiation source to form a barrier layer on an inner surface of the container;

discharging a residual barrier material precursor gas or/and a by-product gas from the interior of container; and introducing liquid food to the interior of the container.

4. The filling method according to claim 3, wherein the liquid food is introduced into the interior of the container through a fill nozzle.

* * * * *